US010724743B2

(12) United States Patent
Faraldi et al.

(10) Patent No.: US 10,724,743 B2
(45) Date of Patent: Jul. 28, 2020

(54) HOUSEHOLD OVEN WITH AN INTEGRATED WATER EVAPORATOR

(71) Applicant: Electrolux Appliances Aktiebolag, Stockholm (SE)

(72) Inventors: Paolo Faraldi, Forli (IT); Lorenzo Gattei, Forli (IT); Agostino Rossato, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 379 days.

(21) Appl. No.: 15/503,728

(22) PCT Filed: Sep. 4, 2014

(86) PCT No.: PCT/EP2014/068876
§ 371 (c)(1),
(2) Date: Feb. 14, 2017

(87) PCT Pub. No.: WO2016/034240
PCT Pub. Date: Mar. 10, 2016

(65) Prior Publication Data

US 2017/0276378 A1 Sep. 28, 2017

(51) Int. Cl.
*H05B 6/80* (2006.01)
*F24C 15/32* (2006.01)
*F24C 15/00* (2006.01)

(52) U.S. Cl.
CPC ..... *F24C 15/327* (2013.01); *F24C 15/003* (2013.01)

(58) Field of Classification Search
CPC ..... H05B 6/80; H05B 6/6408; H05B 6/642; H05B 6/6473; H05B 6/6476; A47J 27/04; F24C 15/327; F24C 15/003
USPC ..... 219/401, 682, 686, 687
See application file for complete search history.

(56) References Cited

U.S. PATENT DOCUMENTS

| | | | | |
|---|---|---|---|---|
| 5,869,812 | A | 2/1999 | Creamer et al. | |
| 6,107,605 | A | 8/2000 | Creamer et al. | |
| 6,175,100 | B1 | 1/2001 | Creamer et al. | |
| 2006/0088301 | A1* | 4/2006 | Kanzaki ..... | F24C 15/327 392/386 |

(Continued)

FOREIGN PATENT DOCUMENTS

| | | | |
|---|---|---|---|
| CN | 2815212 | Y | 9/2006 |
| DE | 19843842 | A1 | 3/2000 |

(Continued)

OTHER PUBLICATIONS

Machine Translation of Berger, DE 19843842 (Year: 2019).*

(Continued)

*Primary Examiner* — Brian W Jennison
(74) *Attorney, Agent, or Firm* — Pearne & Gordon LLP

(57) ABSTRACT

The invention relates to an oven comprising an oven cavity (10) with a closable opening (12) for receiving food to be cooked or baked, an evaporation cavity (26) in a bottom wall (24) of the oven cavity (10) and an evaporation heating element (28) being arranged for heating the evaporation cavity (26). According to the invention the evaporation cavity (26) is formed as an embossment in the bottom wall (24) of the oven cavity (10) and the heating power of the evaporation heating element (28) is adapted to evaporate a volume of water to be evaporated that corresponds to the volume of such an embossment.

16 Claims, 6 Drawing Sheets

(56) References Cited

U.S. PATENT DOCUMENTS

Figure 1:
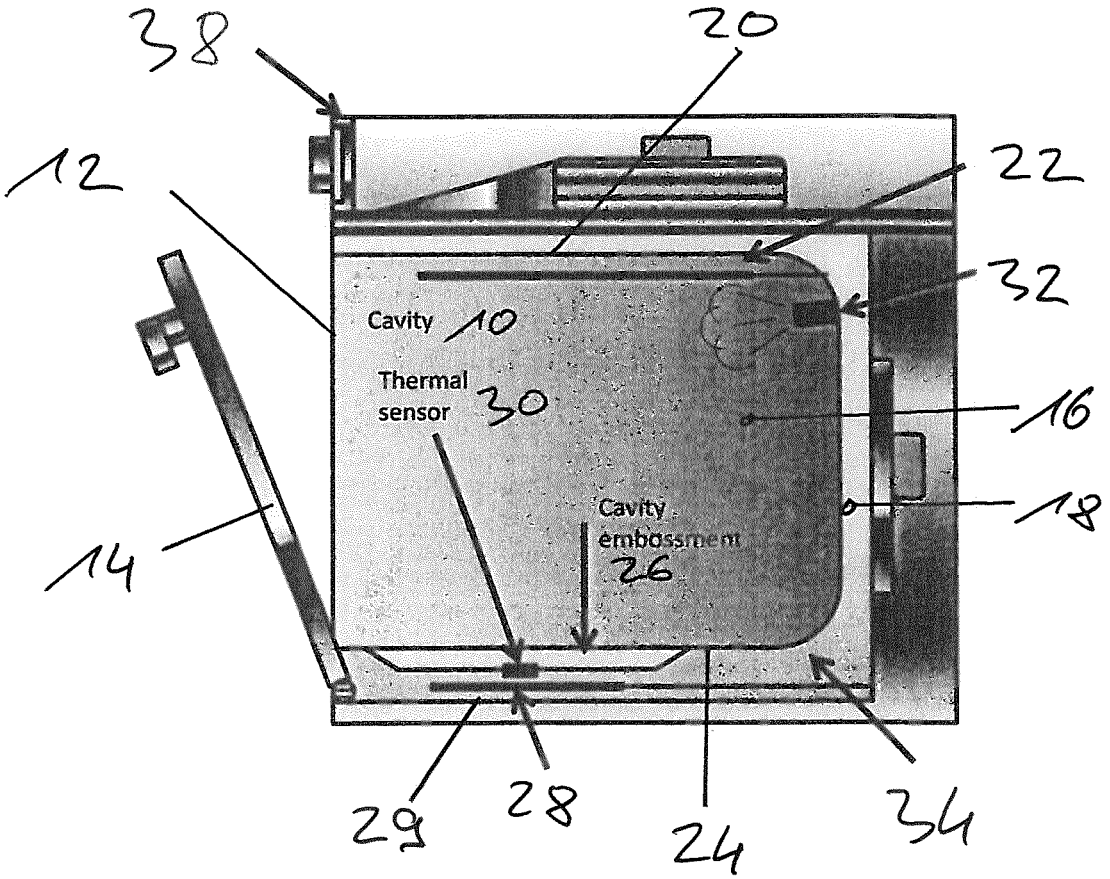

| | | | | |
|---|---|---|---|---|
| 2009/0194092 | A1* | 8/2009 | Shon | F24C 15/327 126/273 R |
| 2010/0264126 | A1* | 10/2010 | Baek | F24C 7/08 219/412 |
| 2011/0049123 | A1 | 3/2011 | Frock | |
| 2012/0199110 | A1* | 8/2012 | Shaffer | F24C 15/327 126/19 R |

FOREIGN PATENT DOCUMENTS

| | | | |
|---|---|---|---|
| DE | 10314590 | A1 | 10/2004 |
| DE | 102010029326 | A1 | 12/2011 |
| EP | 0279065 | A2 | 8/1988 |
| EP | 1607684 | A1 | 12/2005 |
| EP | 1995525 | A1 | 11/2008 |
| EP | 2088378 | A2 | 8/2009 |
| EP | 2462809 | A1 | 6/2012 |
| JP | 2006002961 | A | 1/2006 |
| WO | 2008077836 | A2 | 7/2008 |
| WO | 2009065197 | A1 | 5/2009 |
| WO | 2010021356 | A1 | 2/2010 |

OTHER PUBLICATIONS

Examination Report issued in corresponding European Patent Application No. 13162830.7 dated Nov. 26, 2018, 9 pages.

Office action issued in corresponding European Patent Application No. 13162830.7 dated Mar. 9, 2017, 5 pages.

Office action issued in corresponding European Patent Application No. 13162830.7 dated Feb. 11, 2016, 4 pages.

European Search Report issued in application No. EP 13162830 dated Jun. 11, 2013; 2 pages.

Chinese Office action issued in corresponding Chinese Patent Application No. 201480081211 dated Jun. 5, 2018 (with translation), 18 pages.

International Search Report & Written Opinion issued in corresponding PCT Application No. PCT/EP2014/068876 dated May 4, 2015, 10 pages.

* cited by examiner

HOUSEHOLD OVEN WITH AN INTEGRATED WATER EVAPORATOR

Known household ovens comprise a cavity with a closable opening for receiving food to be cooked wherein the oven cavity is made of metal parts or sheets which are welded together to create the cavity. The internal sides of the cavity are often enameled. Heating elements are provided for heating the cavity. Top and grill heating elements are placed inside the cavity in the upper region, a ring heating element surrounds a convection cooking fan, whereas bottom heating elements are placed outside and underneath the cavity.

EP 0 279 065 A2 discloses an oven comprising in addition a steam generator. The steam generator comprises a pot which is mounted into an opening in the bottom wall of the oven cavity. A heating element is provided for heating water that is filled into the pot in order to generate steam which enters the oven cavity.

It is a disadvantage of such known ovens that the integration of a separate pot into the bottom wall of the oven cavity leads to an increase in production complexity and hence to additional costs. The insertion of a separate pot requires a corresponding hole in the bottom wall as well as a connection between pot and cavity like seam welds. Hence, the production of the parts and the assembly is not only rather complex, but such a solution also leads to possible cleanability issues. In addition, a separate pot defines a larger volume corresponding to larger amount of water to be received. Hence, corresponding heating elements are provided which supply a significant amount of heating power. As a result more steam is generated. In addition, steam outlets have to be provided for discharging excessive steam from the oven cavity. On the other hand, the implementation of a separate pot provides additional stiffness and structure to the steel sheet constituting the oven cavity bottom, typically quite thin.

It is therefore an object of the present invention to provide an oven with an evaporation cavity for water wherein the aforementioned disadvantages are overcome.

Particular embodiments are described with reference to the enclosed drawings in the following.

According to the invention the evaporation cavity is formed as an embossment in the bottom wall of the oven cavity, and the evaporation cavity has a maximum volume that is limited by the formation of the evaporation cavity as an embossment in the bottom wall of the oven cavity.

An advantage of an oven according to the present invention is the fact that such an oven is easy to produce and does not require complicated procedures during assembly. This is based on the fact that the evaporation cavity is a deep drawn impression in the bottom of the oven cavity. Such a deep drawing process is less complex and less expensive than the integration of a separate pot into the bottom of the oven cavity. The evaporation cavity can be defined during the deep drawing simultaneously with other reinforcement structures (against buckling) and can act itself as such a reinforcement structure since such an embossment also reinforces the bottom of the oven cavity against buckling issues. The resulting evaporation cavity can be cleaned easily since it is integrated in one piece and hence in a seamless manner into the bottom wall of the oven cavity. In addition, the volume of an embossment in the bottom of the oven cavity is smaller than the volume of known evaporation cavities.

In a preferred embodiment of the invention the evaporation cavity is integrally formed into the bottom wall of the oven cavity wherein the bottom wall of the oven cavity preferably is a sheet of metal and the evaporation cavity is embossed into this metal sheet.

In a further preferred embodiment of the invention, the oven cavity is made out of a formed metal sheet, in one or more parts assembled together, and a layer of enamel is applied on the inner surface, to protect against corrosion, enhance cleanability, and give an highly aesthetic finish to the surface.

Direct storage of the water in the embossment also allows ensuring condensation reflow in the embossment itself, which is helped by the typical shape of a cavity bottom including the embossment itself.

Moreover, no additional components are requested, and no further efficiency reduction due to an additional heat exchange occurs.

In a further preferred embodiment of the invention the evaporation heating element has a maximum heating power that is adapted to heat a volume of water to be evaporated that corresponds to the volume of said evaporation cavity. Thus, according to the present invention an evaporation heating element with reduced power can be used. In other words, the power of the evaporation heating element can be selected to be specific to, or otherwise correspond to the volume of the evaporation cavity.

Since the present invention provides an oven with an evaporation cavity of a reduced size, also a reduced quantity of water is evaporated. Hence, an evaporation cavity according to the present invention which has a volume which is limited by its formation as an embossment in the bottom wall of the oven cavity, and in particular said evaporation cavity with an evaporation heating element with a corresponding power, cannot only be used as primary steam generator in case only a smaller amount of steam is required but also as a supplementary evaporator in case that a primary steam generator with a separate water source independent of the evaporation cavity is already provided. In addition it can also be used in combination with a primary steam generator as a condensate evaporator only where condensed water shall be re-evaporated, or for baking or cooking where only a small amount of steam and humidity is desired.

In a further preferred embodiment the evaporation heating element is provided in an area underneath the evaporation cavity, preferably without having a direct mechanical contact to the evaporation cavity. Avoiding a direct contact reduces the thermal stress applied to the bottom wall of the cavity and reduces the danger of damaging an enamel coating since hot spots and critical thermal gradients are avoided.

Further preferably, the oven comprises a bottom heating element comprising a primary heater loop and a secondary heater loop, wherein the primary heater loop is arranged underneath the oven cavity in an area that at least partially surrounds the area underneath the evaporation cavity and the evaporation heating element comprises said secondary heater loop, preferably wherein the primary heater loop at least partially surrounds the secondary heater loop. Hence bottom heat and evaporation are induced and controlled by different heater loops. This configuration allows to have the oven performing standard cooking operations (as in a standard oven equipped with a standard bottom heater) when the primary heater loop is activated and the secondary heater loop is inactive (e.g., in an off state).

The primary heater loop and the secondary heater loop can be arranged between the bottom wall of the oven cavity including the evaporation cavity and a cover plate arranged vertically beneath and covering the heater loops. The bottom wall of the oven cavity and the cover plate hence define a box comprising the heater loops. This is particularly advantageous for the overall oven assembly process, and it allows a precise positioning of the loops in terms of distance from the bottom wall where a mandatory minimum distance is requested to ensure enamel integrity. This is due to the fact that an insulation blanket can be continuous (avoiding cutouts) and arranged outside and below the cover plate without touching or pushing the loops. This also ensures a more homogeneous irradiation, resulting in an even heat flow towards the whole cavity bottom. This effect is also based on reflection effects of the cover plate. The presence of the cover plate along with a continuous insulation blanket also minimizes the heat loss toward the outside of the cavity, optimizing the performances in terms of energy consumption.

Preferably the primary heater loop and the secondary heater loop are arranged on two different, essentially parallel planes, such that both heater loops maintain essentially the same distance from the bottom wall of the oven cavity, respectively in the area surrounding the area underneath the evaporation cavity and in the area underneath the evaporation cavity.

The primary heater loop and the secondary heater loop can preferably be arranged in a distance from the respective nearest point of the bottom wall of 5 to 25 mm, more preferably of 2 to 12 mm. This reflects a balance between the thermal stress applied to the bottom wall and a sufficient heat transfer.

The primary heater loop and the secondary heater loop can be controllable such that the primary heater loop can be activated together with or without the secondary heater loop. As mentioned before, this offers the possibility to use the oven in a standard mode with bottom heat only (or in combination with other heating elements) with only the primary heater loop active or, alternatively, with additional steam generation with both the primary and secondary heater loops active. This possibility is vital to ensure a reliable operation of the oven, in particular for enameled oven cavities; the activation of the secondary loop, whose heating action is focused on the cavity bottom centre, could induce an uneven thermal field, particularly dangerous for the enamel layer, prone to crack where local deformations should occur due to temperature differences. Thus, a controller is operable to prevent operation of the secondary heater loop for sustained periods to evaporate water in the evaporation cavity while the primary heater loop is inactive. When heating both loops, the heat distribution is evened over the whole cavity bottom, avoiding thermal gradients which could lead to enamel damages. It has to be clarified that the power output requested to the primary loop to perform the above mentioned warming action is much lower than the power output required for cooking functions, e.g. in a ratio between ½ to 1/10.

A preferred way to achieve this contemporary activation of primary and secondary loop, having the former generating a reduced power output, is to have the primary heater loop and the secondary heater loop activated together by switching them into a series electrical connection, wherein the primary heater loop and the secondary heater loop preferably are in an ohmic value ratio between 1 to 0.2, wherein the secondary heating element has higher ohmic value. As an example, a primary loop capable of a 1 kW power output, is switched in series with a secondary loop having an ohmic value ratio of 1, would provide a power of 250 W, as the secondary loop itself; for a nominal operating voltage of 230V, the ohmic value of both elements would correspond to 52Ω.

As another example, a primary loop capable of a 2.4 kW power output, is switched in series with a secondary loop having an ohmic value ratio of 0.66, would provide a power of 400 W, while the secondary loop would provide a power of 600 W. For a nominal operating voltage of 230V, the ohmic value of primary loop would correspond to 22Ω, the secondary loop's one would correspond to 33Ω.

In a preferred embodiment the evaporation cavity is adapted to receive a volume of water to be evaporated which is preferably a volume between 10 and 300 ml, more preferably between 50 to 250 ml and the heating power of the evaporation heating element is adapted to evaporate such a volume of water. This supports use cases where rather small amount of steam are desired or where the evaporation cavity acts as a secondary steam generator together with an e.g. external primary steam generator.

At least an area of the bottom wall adjacent to the evaporation cavity can have a down-grade towards the evaporation cavity in order to direct a condensate towards and into the evaporation cavity and/or to stiffen the bottom wall wherein preferably the angle of the down-grade is in a range between 1 and 7 degrees with respect to the horizontal. Hence condensed water is guided towards the evaporation cavity and is evaporated again in order to control the humidity in the cavity or to maintain the bottom wall dry.

The evaporation cavity preferably has a diameter between 5 cm to 25 cm, more preferably between 7 cm and 17 cm and/or the embossment of the evaporation cavity has a maximum depth between 2 and 20 mm, more preferably between 5 and 10 mm.

In preferred embodiments the embossment defines the evaporation cavity by means of two consecutive bends leading to a downwardly orientated step in the bottom wall of the oven cavity wherein the bends have a respective radius between 5 and 20 mm, more preferably between 6 and 8 mm Such radii turned out to provide a good base layer for enamel coatings since the risk of enamel damages is reduced. According edges are mild enough to prevent stresses on the enamel, avoid water flow blockage, and permit an effective cleaning action thanks to the absence of hindering areas where dirt or limestone can get stuck. According to such embodiments, the bottom wall of the oven cavity and the evaporation cavity are integrally formed as a monolithic, continuous sheet of metal or other suitable material. Integrally formed in such a manner, the evaporation cavity is not separable from the surrounding portion of the bottom wall of the oven cavity.

A bottom of the evaporation cavity can have a down-grade towards a center of the bottom of the evaporation cavity. This stiffens the evaporation cavity and improves the flow of condensate towards the center of the cavity.

In a further preferred embodiment the evaporation cavity or a bottom of the evaporation cavity is concave when seen from the inner side of the oven cavity, wherein preferably a curvature of the evaporation cavity or of the bottom of the evaporation cavity defines a radius between 200 and 500 cm, more preferably between 300 and 400 cm.

Preferably a temperature sensor is provided which is adapted to measure the temperature in the area of the evaporation cavity and to preferably control an electrical power provided towards the evaporation heating element.

Preferably evaporation cavity is provided with a dirt cover, permeable to steam and shaped to allow water and condensate flow from the cavity walls and bottom into the evaporation cavity.

Figure 2:
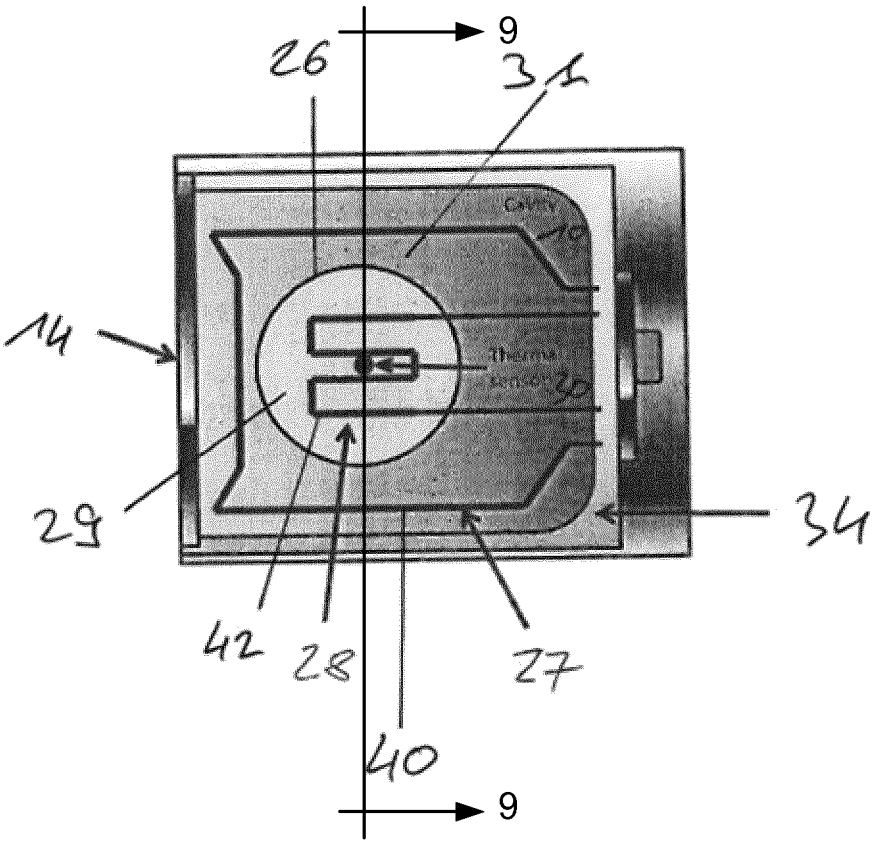
Figure 3:
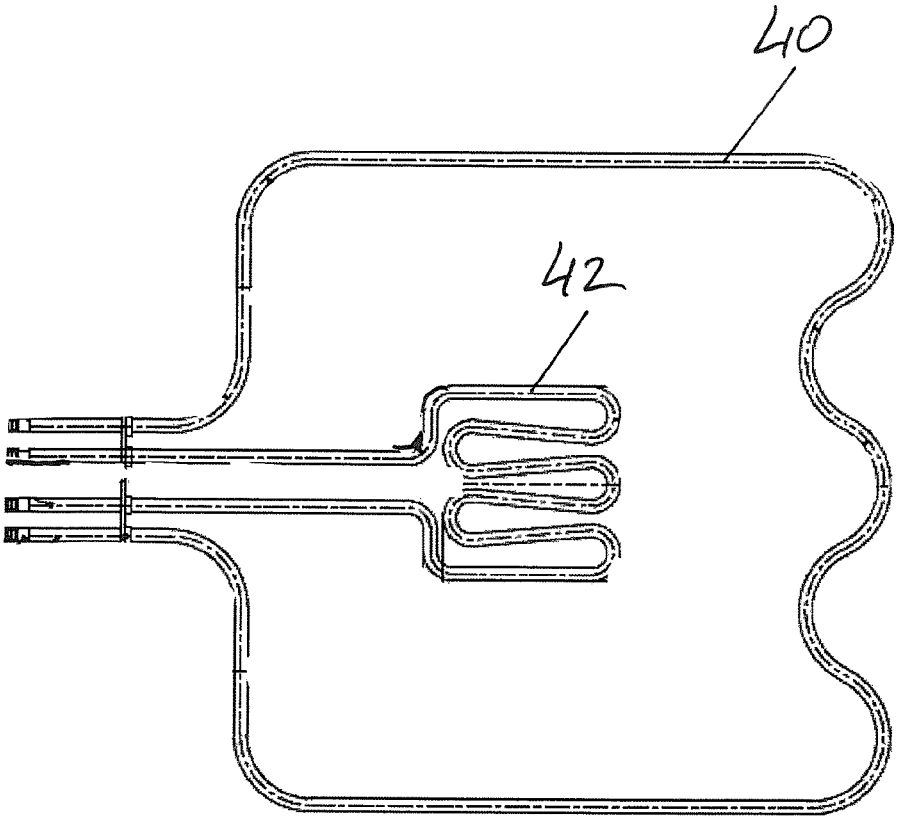
Figure 4:
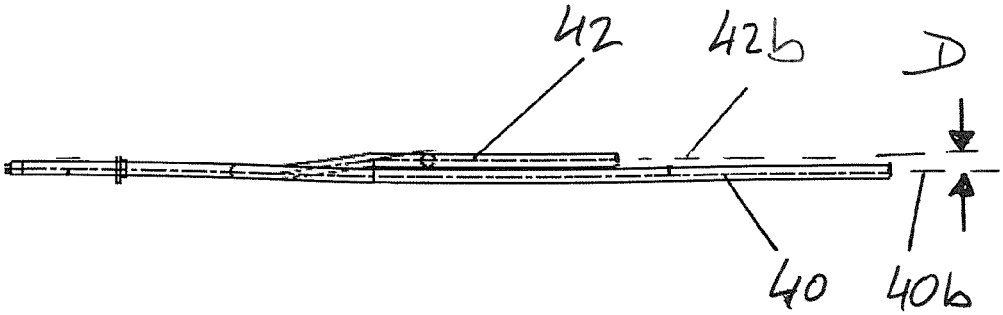
Figure 5:
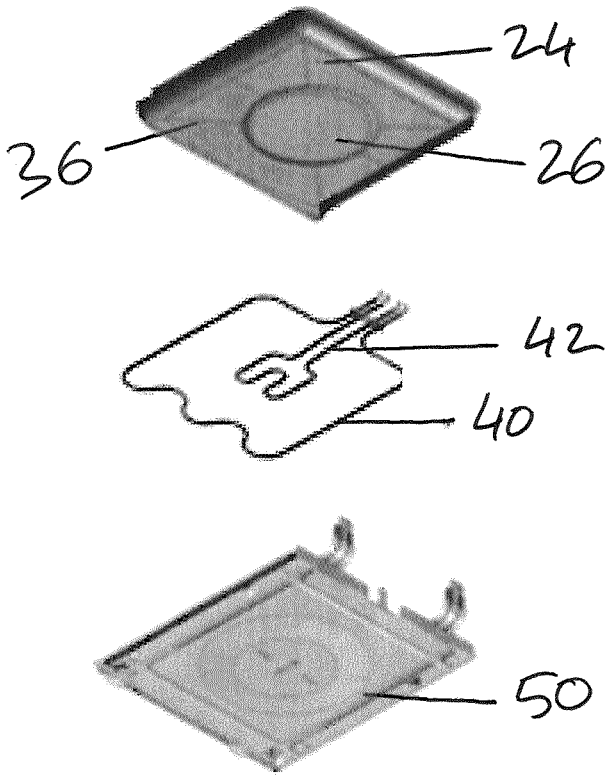
Figure 6:
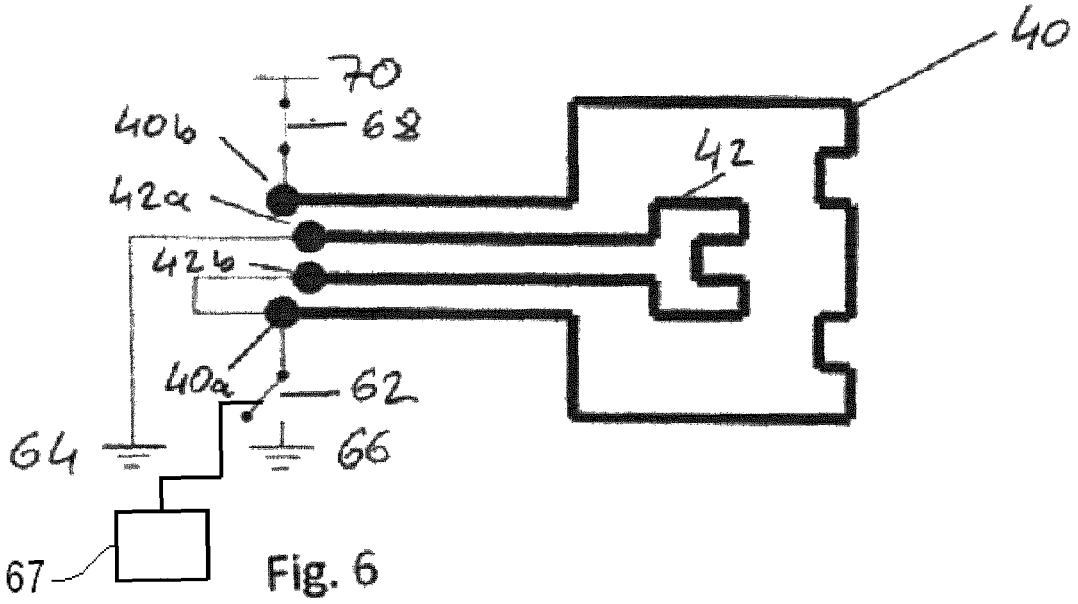
Figure 7:
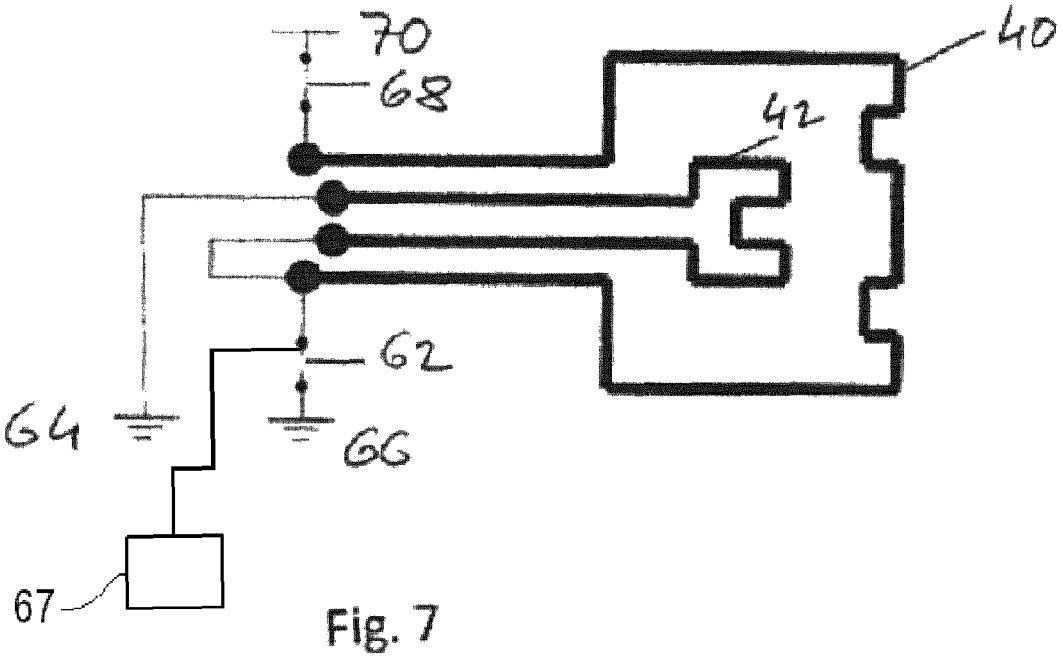
Figure 8:
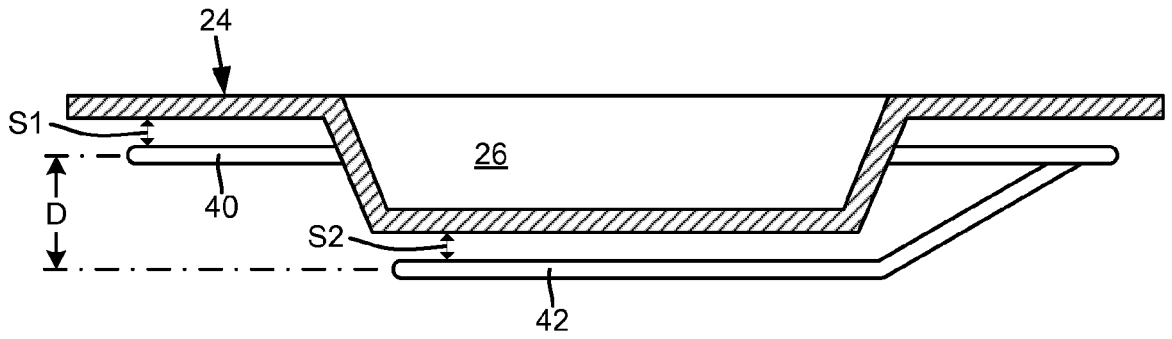
Figure 9:
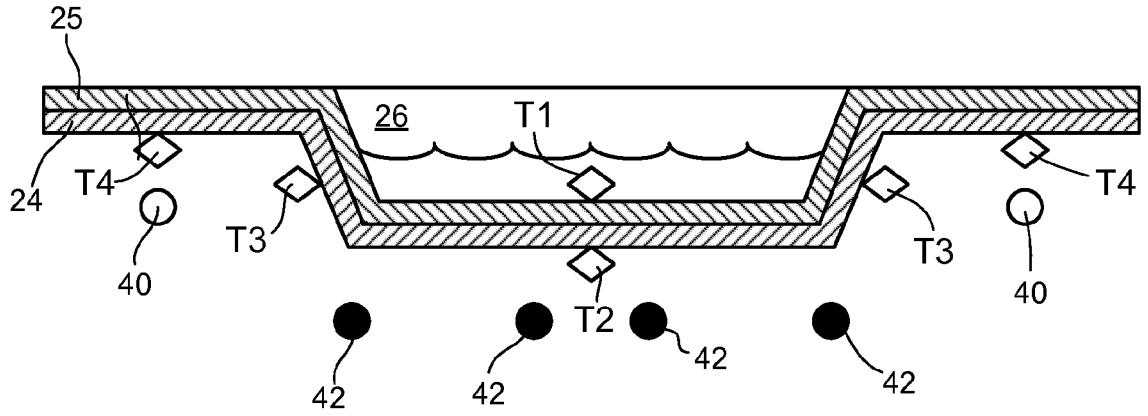
Figure 10:
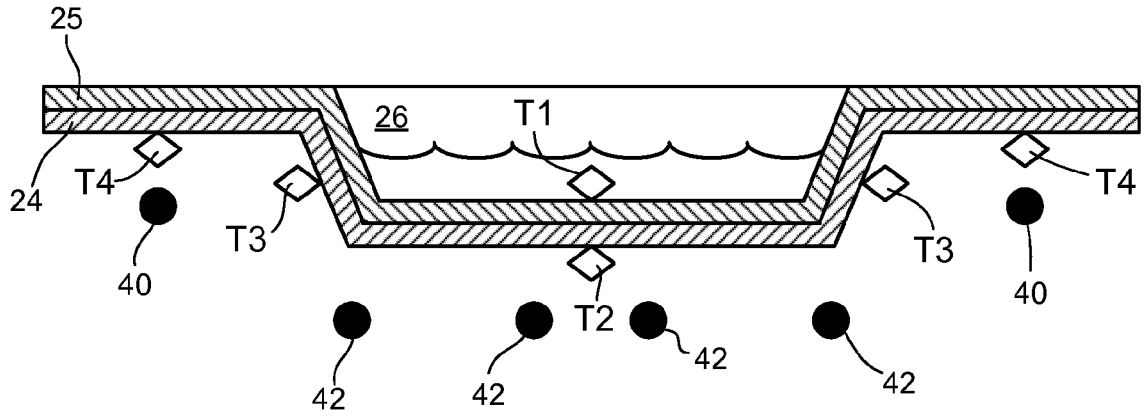

An example of an oven according to the present invention is described below by reference to the accompanying schematic drawings in which:

FIG. 1 shows a cross-sectional side view of an oven according to the present invention, and FIG. 2 shows a cross-sectional view from below, FIG. 3 shows a view from below onto a bottom heating element, FIG. 4 shows a side view of the bottom heating element of FIG. 3, arranged upside down such that a secondary heater loop, which is to be installed to be arranged at an elevation that is lower than an elevation of a primary heating loop, appears above the primary heating loop, FIG. 5 shows a cavity bottom wall, heater loops and a cover plate in an exploded view, FIG. 6 shows a circuit diagram of an evaporation heating element and a bottom heating element where both heating elements are activated, FIG. 7 shows the heating element of FIG. 3 in a switching state where only the bottom heating element is activated, FIG. 8 shows an partially cutaway view of a bottom wall provided with an evaporation cavity arranged adjacent to a heating element assembly that includes a primary heater loop and a secondary heater loop equally spaced apart from a surrounding region of the bottom wall and a bottom of the evaporation cavity, respectively;

FIG. 9 shows a sectional view of an enamel coated bottom wall provided with an evaporation cavity arranged adjacent to primary and secondary heater loops taken along line 9-9 in FIG. 2, in an operational state where a secondary heater loop is active; and FIG. 10 shows a sectional view of an enamel coated bottom wall provided with an evaporation cavity arranged adjacent to primary and secondary heater loops taken along line 9-9 in FIG. 2, in an operational state where both the primary and the secondary heater loops are connected in series and active.

FIG. 1 shows an oven comprising a cavity 10 with a closable opening 12 for receiving food to be cooked or baked within the oven cavity 10. The opening 12 can be closed by means of a front door 14. The oven cavity 10 is defined by sidewalls 16, a rear wall 18, a top wall 20 and a bottom wall 24. A top heating or grill element 22 is mounted in the upper region of the oven cavity 10. The bottom wall 24 comprises an evaporation cavity 26 which is a deep drawn embossment. The embossment defining the evaporation cavity 26 is worked into a steel sheet constituting the bottom wall 24 during a shaping operation where the bottom wall 24 of the oven cavity 10 is defined. Like the bottom wall 24 also sidewalls 16, rear wall 18 and top wall 20 are made of steel sheets and are enameled. An evaporation heating element 28 is provided for heating the evaporation cavity 26 in an area 29 underneath the evaporation cavity 26. The heating power of the evaporation heating element 28 is adapted to evaporate a volume of water to be evaporated that corresponds to the volume of the evaporation cavity 26. The evaporation cavity 26 together with the evaporation heating element 28 act as a steam generation system. Water can be conveyed into the evaporation cavity 26 either by direct pouring or by means of a pipe or a channel. By activation of the evaporation heating element 28 the water is evaporated. The evaporation heating element 28 is arranged in an area 29 underneath the evaporation cavity 26 and can be a second branch of an also provided standard bottom heating element with independent control. This will be explained in more detail in connection with the following Figures. The evaporation heating 28 element is self-supporting and not in direct contact with the bottom wall 24 and the embossment defining the evaporation cavity 26. As an alternative, such an evaporating heating element can be a heating device directly fixed onto the external surface of the embossment defining the evaporation cavity 26 (e.g. a standard heater, a thick film heater, welded, glued or fixed by other means directly onto the external surface of the evaporation cavity 26). A thermostat or temperature sensor 30 is applied to the external surface of the evaporation cavity 26 to prevent overheating (e.g. upon run-out of water) or to control the power delivery and hence the evaporation. The oven can also comprise a steam inlet 32 which is connected to an (not shown) external steam generator so that the evaporation cavity 26 together with the evaporation heating element 26 acts as auxiliary generator or condensation re-evaporator collecting condensate and re-evaporating it. But of course the evaporation cavity 26 and the evaporation heating element 28 can also be used as the only source of steam and/or humidity without an additional steam generator. The evaporation cavity 26 can be protected by a cover, shaped to fit onto it in order to prevent food debris to get in contact with the hot evaporation cavity 26 which would lead to cleanability issues. Since the evaporation cavity 26 is preferably designed to receive a volume of water between 10 and 300 ml, more preferably between 50 to 100 ml, the evaporation heating element 28 preferably provides a heating power between 300 and 800 W so as to be adapted to evaporate an according volume of water during a typical cooking or baking time. A user interface 38 is provided for controlling the oven.

FIG. 2 shows the oven of FIG. 1 in a sectional view from below. A cover plate which normally covers heater loops, is removed. As can be seen from FIG. 2, the oven comprises an electrical bottom heating element 27 which in turn comprises a primary heater loop 40 for providing bottom heat to the oven cavity 10. This primary heater loop 40 surrounds a secondary electrical heater loop 42 which relates to the evaporation heating element 28. The secondary heater loop 42 is provided in an area 29 underneath the evaporation cavity 26 whereas the primary heater loop 40 is arranged in an area 31 that excludes the area 29 underneath the evaporation cavity 26. Primary heater loop 40 is arranged underneath the oven cavity 10 too.

FIGS. 3 and 4 show a primary heater loop 40 and a secondary heater loop 42 which are arranged in two different, essentially parallel planes 40*b* and 42*b*, respectively. These heater loops 40 and 42 can be installed in the oven according to FIGS. 1 and 2 (where the corresponding loops 40 and 42 are shown more schematically). Thus, the assembly including the primary and secondary heater loops 40, 42 is shown in FIG. 4 upside down. Properly installed in the present oven as shown in FIG. 8, however, the secondary heater loop 42 is arranged at an elevation that is lower than an elevation of a primary heating loop 40 by the distance D. However, since the assembly is inverted in FIG. 4, the secondary heater loop 42 appears vertically above the primary heater loop 40. Both planes 40*b* and 42*b* are arranged in a distance D to each other wherein the plane 42*b* comprising the secondary heater loop 42 is above the plane 40*b* of the primary heater loop 40, wherein "above" refers to an assembled condition of the oven. The distance D between both planes 40*b* and 42*b* is such that both heater loops 40 and 42 maintain essentially the same distance from the bottom wall 24 of the oven cavity, respectively in the area 31 surrounding the area 29 underneath the evaporation cavity 26 and in the area 29 under the evaporation cavity 26. For example, in the enlarged, sectional view shown in FIG. 8, the separation S1 between the bottom of the area 31 surrounding the evaporation cavity 26 and the primary heater loop 40, and the separation S2 between the bottom of the evaporation cavity 26 and the secondary heater loop 42 is approximately the same.

FIG. 5 shows the cavity bottom wall 24 with the evaporation cavity 26 the heater loops comprising the primary heater loop 40 and the secondary heater loop 42 and a cover plate 50 in an exploded view. The cover plate 50 is designed for protecting the primary heater loop 40 and the secondary heater loop 42. In addition to the evaporation cavity 26 also additional reinforcing structures 36 are embossed or deep drawn into the bottom wall 24. A heat insulating layer e.g. of a fibrous material will be arranged below the cover plate 50.

FIGS. 6 and 7 show a schematic connection diagram comprising the primary heater loop 40 and a secondary heater loop 42 of FIGS. 2 and 5 that are controllable by a controller 67. The controller 67 includes suitable electronic components and is otherwise adapted to issue control signals for establishing the operational modes of the oven described herein. According to FIG. 6, in response to a user-input command received by the controller 67 identifying a desired cooking mode, a first end 42*a* of secondary heater loop 42 is electrically connected to electrical ground 64 pursuant to an instruction from the controller 67. A second end 42*b* of secondary heater loop 42 is connected to a first end 40*a* of primary heater loop 40 which in turn is also connected via a breaker 62 to electrical ground 66. A second end 40*b* of primary heater loop 40 is connected via breaker 68 to a source of electrical power 70. When, as shown in FIG. 6, breaker 68 is closed (conducting) and breaker 62 is open, both heater loops 40 and 42 are switched into a series electrical connection and are activated by a current running from the source of electrical power 70 to electrical ground 64 to establish an operational mode of heat and steam.

In the configuration of FIG. 7 where both breakers 62 and 68 are closed by the controller 67 the circuit is configured such that electrical current is running from the source of electrical power 70 through the primary heater loop 40 and through the closed breaker 62 to electrical ground 66 (due to the low resistance of breaker 62 in comparison to secondary heater loop 42). In this case only primary heater loop 40 is activated (heated) whereas secondary heater loop 42 is basically switched off so that the evaporation cavity 26 is not heated directly. Therefore, the second configuration of FIG. 5 relates to the case where the oven is used with bottom heating only and without steam generation. Accordingly, the controller 67 can be configured to operate the primary heater loop 40, without the secondary heater loop 42, and optionally in combination with another heater loop (e.g., convection heating element, broil heating element, etc. . . . ), or to operate both the primary heater loop 40 in combination (e.g., in series) with the secondary heater loop 42. The controller 67 can thus optionally prevent sustained operation of the secondary heater loop 42 without also requiring activation of the primary heater loop 40.

By preventing sustained operation of the secondary heater loop 42 while the primary heater loop 40 is off, thermal stresses on the enamel coating resulting from the different coefficients of thermal expansion of the enamel and the metal from which the bottom wall 24 is formed can be minimized To illustrate this concept, FIG. 9 shows a schematic sectional view of the bottom wall 24 provided with an evaporation cavity and an enamel coating 25 arranged adjacent to the primary and secondary heater loops 40, 42 taken along line 9-9 in FIG. 2. Points where the local temperatures discussed below are present are identified by temperatures T1, T2, T3 and T4. T1 represents the temperature of the enamel coating 25 adjacent to a central region at the bottom of the evaporation cavity 26. T2 represents the temperature of the metal material from which the bottom wall 24 was formed adjacent to a central region at the bottom of the evaporation cavity 26, opposite the location of the temperature T1. T3 represents the temperature of the metal material of the bottom wall 24 along an angled region between bends in the material to form the evaporation chamber 26. And T4 represents the temperature of the metal material of the bottom wall 24 in a surrounding region of the bottom wall 24 that is substantially horizontal and located radially outward from the central region of the evaporation cavity 26, beyond the exterior periphery of the evaporation cavity 26.

The oven in FIG. 9 is in the operational state prevented by the controller 67, where only the secondary heater loop 42 is active. The active, or operational heater loops are represented in FIGS. 9 and 10 by the solid-filled circles representing the cross section of the heater loops 40, 42, and the off heater loops are represented by open, or unfilled circles. Prolonged operation of the oven in the operational state represented in FIG. 9 can result in the following approximate, steady-state temperatures T1-T4 being established:

TABLE 1

| Temperature Gradients with Oven in Prevented Operational Mode | |
|---|---|
| T1 | ~100° C. |
| T2 | 120-140° C. |
| T3 | 130-160° C. |
| T4 | Room Temperature-40° C. |

As can be seen from Table 1, the differences in temperature of the metal material forming the bottom wall 24 at T2, T3 and T4 can cause the metal material to expand to a different extent at each location. Such differences in expansion can exert significant stress on the enamel coating 25, thereby promoting the formation of cracks in, or otherwise damaging that enamel coating 25.

In an effort to combat damage to the enamel coating 25 as a result of different rates of expansion between T4 and T2 and T3, the controller 67 is adapted to connect the primary and secondary heater loops 40, 42 in series during an operational mode of the oven that generates steam from the water in the evaporation cavity 26. In this operational mode, the primary heater loop 40 is operational (i.e., on), but at a lower power output than a power output at which the primary heater loop 40 is operated when the oven is in a standard bake operational mode (when the primary heater loop 40 is operational but the secondary heater loop 42 is off, and steam is not being generated). Such an operational mode is represented schematically in FIG. 10. Prolonged operation of the oven in the operational state represented in FIG. 10 can result in the following approximate, steady-state temperatures T1-T4 being established:

TABLE 2

| Temperature Gradients with Oven in Enamel-Preserving Operational Mode | |
|---|---|
| T1 | ~100° C. |
| T2 | 120-140° C. |
| T3 | 130-160° C. |
| T4 | 100-130° C. |

As shown in Table 2, the differences in temperature gradients that exist between T4 and T2 and T3 are much smaller than the corresponding temperature gradients present when the oven is operated in the operational mode represented in FIG. 9. In fact, the temperature ranges for T2, T3 and T4 can optionally overlap. The smaller temperature gradients promote similar thermal expansion of the metal forming the bottom wall 24, thereby exerting less stress on the enamel coating 25.

The invention claimed is:

1. An oven comprising:

an oven cavity with a closable opening for receiving food to be cooked or baked;

an evaporation cavity arranged and formed as an embossment in a bottom wall of the oven cavity, the evaporation cavity having a maximum volume that is limited by the embossment in the bottom wall of the oven cavity;

a primary heater loop arranged underneath the oven cavity and at least partially surrounding the evaporation cavity; and a secondary heater loop effective to provide a heating power, the secondary heater loop arranged underneath, but not in contact with, the evaporation cavity for evaporating water within the evaporation cavity, said secondary heater loop being at least partially surrounded by said primary heater loop, said primary and secondary heater loops being operably connected to a controller such that, in a first mode the controller can activate the primary heater loop without activating the secondary heater loop in order to supply cooking power without steam generation, and in a second mode the controller can activate both the primary and secondary heater loops to supply both cooking power and steam generation, wherein activation of the secondary heater loop for sustained periods is prohibited while the primary heater loop is inactive, said controller being adapted to connect the primary and secondary heater loops in series during said second mode, such that in the second mode said primary heater loop delivers a lower power output than in said first mode.

2. The oven according to claim 1, wherein the secondary heater loop has a maximum heating power that is specific to heat a volume of water to be evaporated that corresponds to the volume of said evaporation cavity.

3. The oven according to claim 1, said embossment being formed in a sheet of metal forming the bottom wall of the oven cavity.

4. The oven according to claim 1, wherein the primary heater loop and the secondary heater loop are arranged between the bottom wall of the oven cavity and a cover plate covering the primary heater loop and the secondary heater loop.

5. The oven according to claim 1, wherein the primary heater loop and the secondary heater loop are arranged in two different, essentially parallel planes, such that the primary heater loop and the secondary heater loop maintain essentially the same distance from the bottom wall of the oven cavity, respectively in an area surrounding an area underneath the evaporation cavity and in the area underneath the evaporation cavity.

6. The oven according to claim 1, said controller being further operable to independently operate the primary heater loop at full power together with the secondary heater loop.

7. The oven according to claim 1, wherein the controller operates the primary heater loop during the second mode at a fraction of a full power of the primary heater loop, said fraction of the full power being from ½ to 1/10.

8. The oven according to claim 1, wherein an area of the bottom wall adjacent to the evaporation cavity has a down-grade towards the evaporation cavity in order to direct a condensate on the area of the bottom wall towards and into the evaporation cavity and to provide a stiffening effect to the bottom wall.

9. The oven according to claim 1, wherein the embossment defines the evaporation cavity by means of two consecutive bends leading to a downwardly orientated step in the bottom wall of the oven cavity.

10. The oven according to claim 1, wherein a bottom of the evaporation cavity has a down-grade towards a center of the bottom of the evaporation cavity.

11. The oven according to claim 1, wherein the evaporation cavity or a bottom of the evaporation cavity is concave when seen from an inner side of the oven cavity.

12. The oven according to claim 1 further comprising: a temperature sensor arranged to measure a temperature adjacent to the evaporation cavity and to emit a temperature signal indicative of the temperature measured; and the controller being configured to receive the temperature signal and, based on the temperature signal, to control an electrical power supplied to the secondary heater loop.

13. The oven according to claim 1, wherein the bottom wall of the oven cavity and the evaporation cavity are enamelled at least on a side facing an interior of the oven cavity.

14. The oven according to claim 1, wherein the evaporation cavity is provided with a dirt cover, permeable to steam and shaped to allow water and condensate flow from the cavity walls and bottom into the evaporation cavity.

15. An oven comprising:

an oven cavity with a closable opening for receiving food to be cooked or baked, an evaporation cavity defined by a deep-drawn embossment integrally formed in a bottom wall of the oven cavity, said evaporation cavity having a volume of 10 to 300 mL, wherein a region of said bottom wall adjacent the evaporation cavity has a down-grade toward the evaporation cavity effective to direct condensate toward and into the evaporation cavity, a layer of enamel applied over an inner surface of said bottom wall of the oven cavity including over an inner surface of said evaporation cavity therein, a primary heater loop arranged underneath the oven cavity and at least partially surrounding the evaporation cavity, a secondary heater loop effective to provide a heating power of between 300 and 800 watts arranged underneath, but not in contact with, the evaporation cavity for evaporating water within the evaporation cavity, said secondary heater loop being at least partially surrounded by said primary heater loop, and a temperature sensor for detecting an overheated condition of the evaporation cavity, said primary and secondary heater loops being arranged on two different, essentially parallel planes, such that they both maintain essentially the same distance from the bottom wall of the oven cavity, said primary and secondary heater loops being operably connected to a controller such that, in a first mode the controller can activate the primary heater loop without activating the secondary heater loop in order to supply cooking power without steam generation, and in a second mode the controller can activate both the primary and secondary heater loops to supply both cooking power and steam generation, wherein activation of the secondary heater loop for sustained periods is prohibited while the primary heater loop is inactive, said controller being adapted to connect the primary and secondary heater loops in series during said second mode, such that in the second mode said primary heater loop delivers a lower power output than in said first mode.

16. The oven according to claim 15, further comprising a dirt cover positionable over the evaporation cavity from inside the oven cavity, said dirt cover being permeable to steam and shaped to allow water and condensate to flow from the oven cavity into the evaporation cavity, but to prevent food debris from contacting the evaporation cavity.

* * * * *